US006156718A

United States Patent [19]

Donoghue et al.

[11] Patent Number: 6,156,718

[45] Date of Patent: Dec. 5, 2000

[54] PROCESS FOR MAKING DETERGENT COMPOSITIONS

[75] Inventors: Scott John Donoghue, Brussels; Marcel Karel Nelis Liplijn, Woluwe St. Lambert; Carole Patricia Denise Wilkinson, Brussels, all of Belgium

[73] Assignee: The Procter & Gamble Company, Cincinnati, Ohio

[21] Appl. No.: 09/214,327

[22] PCT Filed: Jun. 27, 1997

[86] PCT No.: PCT/US97/11281

§ 371 Date: Jan. 4, 1999

§ 102(e) Date: Jan. 4, 1999

[87] PCT Pub. No.: WO98/01520

PCT Pub. Date: Jan. 15, 1998

[30] Foreign Application Priority Data

Jul. 4, 1996 [EP] European Pat. Off. ..... 96201854

[51] Int. Cl.[7] ..... C11D 11/00

[52] U.S. Cl. ..... 510/444; 510/309; 510/315; 510/349; 510/375; 510/378; 510/441; 510/507

[58] Field of Search ..... 510/444, 441, 510/309, 315, 349, 375, 378, 507; 252/186.3, 186.43

[56] References Cited

U.S. PATENT DOCUMENTS

| | | | |
|---|---|---|---|
| 4,136,051 | 1/1979 | Saran et al. | 252/91 |
| 4,347,152 | 8/1982 | Wixon | 252/174 |
| 5,529,715 | 6/1996 | Kuroda et al. | 510/349 |
| 5,691,296 | 11/1997 | Agar et al. | 510/441 |
| 5,698,510 | 12/1997 | Wilkinson et al. | 510/444 |
| 5,705,473 | 1/1998 | Kuroda et al. | 510/441 |
| 5,780,410 | 7/1998 | Baillely et al. | 510/220 |

FOREIGN PATENT DOCUMENTS

| | | | |
|---|---|---|---|
| 0 578 871 A1 | 1/1994 | European Pat. Off. | C11D 3/12 |
| 98/01520 | 1/1998 | WIPO . | |

OTHER PUBLICATIONS

Research Disclosure Apr. 1990—*Detergent Powder Production*—#31210—pp. 358–359.

*Primary Examiner*—Lorna M. Douyon
*Attorney, Agent, or Firm*—Brian M. Bolam; Kim William Zerby; Steven W. Miller

[57] ABSTRACT

A process for making a detergent composition comprises the steps of: (i) mixing together at least two non-surfactant additives to form a premix; (ii) spraying all of the nonionic surfactant on to the premix to form a first intermediate particle; (iii) subsequently mixing the first intermediate particle with a second intermediate particle, wherein the second intermediate particle comprises anionic surfactant.

6 Claims, No Drawings

PROCESS FOR MAKING DETERGENT COMPOSITIONS

The present invention relates to a process for making detergent compositions

There is a trend amongst commercially available granular detergents towards higher bulk densities. This gives benefits both for consumer convenience and for reduction of packaging materials.

Many of the prior art attempts to move in this direction have met with problems of poor solubility properties arising from low rate of dissolution or the formation of gels. A consequence of this in a typical washing process can be poor dispensing of the product, either from the dispensing drawer of a washing machine, or from a dosing device placed with the laundry inside the machine. This poor dispensing is often caused by gelling of particles which have high levels of surfactant upon contact with water. The gel prevents a proportion of the detergent powder from being solubilised in the wash water which reduces the effectiveness of the powder. Another adverse consequence arises even if the powder is well dispersed and dispersed in the washing water if it does not dissolve rapidly. The wash cycle has a limited duration during which the detergent can act upon the laundry. If the cleaning action is delayed because the powder is slow to dissolve, this, too, will limit the effectiveness of the powder.

The process engineer and formulator have frequently found that the need for good dispensing and the need for good dissolution rate have placed conflicting demands upon them. The solution has generally been to find a compromise which gives adequate dispensing and adequate dissolution rate. For example, poor dispensing of high bulk density granular detergents is often associated with surfactant rich particles having a high specific surface area, either due to high porosity or a small particle size (especially "fines"). However, decreasing the porosity and/or increasing the average particle size cause the dissolution rate to decrease.

W094/05761, published on 17th March 1994, describes a final product densification step wherein substantially all of the product is sprayed with nonionic surfactant and coated with zeolite. Good dispensing and dissolving properties are claimed.

However it has now been found that even further improvements in dispensing and dissolving properties can be achieved if the nonionic surfactant and zeolite coating is applied only to selected parts of the detergent composition, rather than to the detergent composition as a whole.

The object of the invention is to provide an improved process for making a detergent composition comprising anionic surfactant, nonionic surfactant and non-surfactant additives.

SUMMARY OF THE INVENTION

The object of the present invention is achieved by a process comprising the steps of:

(i) mixing together at least two non-surfactant additives to form a premix;

(ii) spraying substantially all of the nonionic surfactant on to the premix to form a first intermediate particle;

(iii) subsequently mixing the first intermediate particle with a second intermediate particle, wherein the second intermediate particle comprises substantially all of the anionic surfactant, and is substantially free of nonionic surfactant.

DETAILED DESCRIPTION OF THE INVENTION

In a preferred embodiment of the process the first intermediate particle is formed by:

(a) mixing together at least two non-surfactant additives to form a premix; and (b) increasing the mean particle size of the premix by spraying nonionic surfactant on to the premix and applying a finely divided particulate material, preferably aluminosilicate.

In a still further preferred embodiment of the process the first intermediate particle is formed by:

(a) mixing together at least two non-surfactant additives to form a premix;

(b) spraying nonionic surfactant on to the premix wherein the ratio of nonionic surfactant to premix is at least 1:25;

(c) applying a first amount of finely divided particulate material, wherein the ratio of the first amount of finely divided particulate material to nonionic surfactant applied in step (b) is less than 1:1;

(d) increasing the mean particle size of the premix by mixing; and (e) applying a second amount of finely divided particulate material, wherein the second amount of finely divided particulate material to nonionic surfactant applied in step (b) is greater than 1:1.

The process of the invention results in a narrow particle size distribution with a sharply defined mean. Preferably the mean particle size is 800 to 1200 micrometers, and the particle size distribution has a standard deviation of less than 100 micrometers. More preferably the mean particle size is from 900 to 1100 micrometers, and the particle size distribution has a standard deviation of less than 50 micrometers.

Non-surfactant additives may include any detergent additives such as bleach, especially perborate or percarbonate; inorganic salts, especially carbonate, bicarbonate, silicate, sulphate, or citrate; chelants, enzymes.

Preferably the first intermediate particle comprises less than 5% by weight of anionic surfactant, more preferably the first intermediate particle comprises less than 1% by weight of anionic surfactant.

Finely divided particulate materials useful herein include aluminosilicates having the empirical formula:

$$M_z(zAlO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3 985 669, Krummel et al, issued Oct. 12, 1976. Preferred synthetic crystalline aluminosilicate ion exchange materials useful herein are available under the designations zeolite A, zeolite P(B), zeolite MAP, zeolite X and zeolite Y. In an especially preferred embodiment, the crystalline aluminosilicate ion exchange material has the formula:

$$Na_{12}[(AlO_2)_{12}(SiO2)_{12}]xH_2O$$

wherein x is from about 20 to about 30, especially about 27. This material is known as zeolite A. Dehydrated zeolites (x=0–10), and "overdried" zeolites (x=10–20) may also be used herein. The "overdried" zeolites are particularly useful when a low moisture environment is required, for example to improve stability of detergent bleaches such as perborate and percarbonate. Preferably, the aluminosilicate has a particle size of about 0.1–10 micrometers in diameter. Preferred ion exchange materials have a particle size diameter of from about 0.2 micrometers to about 4 micrometers. The term "particle size diameter" herein represents the average particle size diameter by weight of a given ion exchange material as determined by conventional analytical techniques such as, for example, microscopic determination utilizing a scanning electron microscope. The crystalline zeolite A materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The zeolite A materials herein are still further characterized by their calcium ion exchange rate which is at least about 2 grains $Ca^{++}$/gallon/minute/gram/gallon (0.13 g $Ca^{++}$/litre/minute/gram/litre) of aluminosilicate (anhydrous basis), and generally lies within the range of from about 2 grains/gallon/minute/gram/gallon(0.13 g $Ca^{++}$/litre/minute/gram/litre) to about 6 grains/gallon/minute/gram/gallon (0.39 g $Ca^{++}$/litre/minute/gram/litre), based on calcium ion hardness. Optimum aluminosilicate for builder purposes exhibit a calcium ion exchange rate of at least about 4 grains/gallon/minute/gram/gallon (0.26 g $Ca^{++}$/litre/minute/gram/litre).

While any nonionic surfactant may be usefully employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

It is a particularly preferred embodiment of the present invention that the nonionic surfactant system also includes a polyhydroxy fatty acid amide component.

Polyhydroxy fatty acid amides may be produced by reacting a fatty acid ester and an N-alkyl polyhydroxy amine. The preferred amine for use in the present invention is N-(R1)—CH2(CH2OH)4-CH2—OH, where R1 is typically a alkyl, e.g. methyl group; and the preferred ester is a C12–C20 fatty acid methyl ester. Methods of manufacturing polyhydroxy fatty acid amides have been described in WO 92 6073, published on Apr. 16, 1992. This application describes the preparation of polyhydroxy fatty acid amides in the presence of solvents. In a highly preferred embodiment of the invention N-methyl glucamine is reacted with a C12–C20 methyl ester.

Other nonionic surfactants which may be used as components of the surfactant systems herein include ethoxylated nonionic surfactants, glycerol ethers, glucosamides, glycerol amides, glycerol esters, fatty acids, fatty acid esters, fatty amides, alkyl polyglucosides, alkyl polyglycol ethers, polyethylene glycols, ethoxylated alkyl phenols and mixtures thereof.

The second intermediate particle of the present invention comprises anionic surfactant. The second intermediate particle may be made by any process including spray drying, flaking, prilling, extruding, pastillating, and agglomeration. Agglomeration processes for making anionic surfactant particles have been disclosed in the prior art in, for example, EP-A-0 508 543, EP-A-0 510 746, EP-A-0 618 289 and EP-A-0 663 439. An essential feature of the invention is that no nonionic surfactant is sprayed on to the surfactant agglomerate stream.

Non-limiting examples of anionic surfactants useful herein include the conventional C11–C18 alkyl benzene sufonates ("LAS") and primary, branched-chain and random C10–C20 alkyl sulfates ("AS"), the C10–C18 secondary (2,3) alkyl sulfates of the formula $CH_3$ $(CH_2)_x$ $(CHOSO_3^-M^+)CH_3$ and $CH_3$ $(CH_2)_y(CHOSO_3^-M^+)$ $CH_2$ $CH_3$ where x and (y+1) are integers of at least about 7, preferably at least about 9, and M is a water-solubilizing cation, especially sodium, unsaturated sulfates such as oleyl sulfate, the C10–C18 alkyl alkoxy sulfates ("$AE_xS$", especially EO 1–7 ethoxy sulfates), C10–C18 alkyl alkoxy carboxylates (especially the EO 1–5 ethoxycarboxylates), the C10–C18 glycerol ethers, the C10–C18 alkyl polyglycosides and their corresponding sulfated polyglycosides, the C12–C18 alpha-sulfonated fatty acid esters, methyl ester sulphonate and oleoyl sarcosinate.

Finally the surfactant agglomerates and layered granular additives are mixed, optionally with additional additives to form a finished detergent composition.

The various mixing steps of the present invention may be carried out in any suitable mixer such as the Eirich®, series RV, manufactured by Gustau Eirich Hardheim, Germany; L ödige®, series FM for batch mixing, series Baud KM for continuous mixing/agglomeration, manufactured by Lödige Machinenbau GmbH, Paderborn Germany; Drais® T160 series, manufactured by Drais Werke GmbH, Mannheim Germany; and Winkworth® RT 25 series, manufactured by Winkworth Machinery Ltd., Berkshire, England; the Littleford Mixer, Model #FM-130-D-12, with internal chopping blades and the Cuisinart Food Processor, Model #DCX-Plus, with 7.75 inch (19.7 cm) blades. Many other mixers are commercially available for both batch and continuous mixing.

| | Example 1 | Example 2 | Example 3 | Example 4 | Example 5 |
|---|---|---|---|---|---|
| Sodium carbonate | 3 | 2 | 2 | 7.8 | — |
| Sodium citrate | — | — | — | — | 10 |
| Sodium bicarbonate | — | — | — | — | 10 |
| Percarbonate | 20 | 16 | 16 | — | — |
| Perborate | — | — | — | 18 | — |
| Enzymes | 1.7 | 2.2 | 2.2 | 1 | 2 |
| Nonionic surfactant particles | 4 | 13 | 19 | 20 | 20 |
| Hydroxy ethylene diphosphonic acid | 1 | 1 | 1 | — | — |
| Tetraacetyl ethylene diamine | 6 | 4.7 | 4.7 | 4 | — |
| Antifoam particle | 2.8 | 1 | 1 | — | — |
| Layered silicate | 15 | 12 | 12 | — | — |
| Sodium silicate (2.0R) | — | — | — | 2 | 3 |
| Sodium sulphate | — | — | — | — | 5 |
| Cationic surfactant particles | 5 | — | — | — | — |
| Brightener | — | — | — | 0.2 | — |
| | 58.5 | 51.9 | 57.9 | 53 | 50 |

All percentages are expressed by weight of finished product unless otherwise stated.

Nonionic surfactant particles contained 15 parts alcohol ethoxylate with an average of 5 EO groups per mole, AE5, 15 parts of polyhydroxy fatty acid amide, 60 parts zeolite, 5 parts fatty acid and 5 parts water, and were made according to the process disclosed in EP-A-0 643 130.

Antifoam particles contained 12 parts silicone oil, 70 parts starch and 12 parts hydrogenated fatty acid/tallow alcohol ethoxylate (TAE80), and were made according to the process disclosed in EP-A-0 495 345.

Layered silicate is SKS-6® supplied by Hoechst Cationic surfactant particles contained 30 parts alkyl dimethyl ethoxy ammonium chloride, 60 parts sodium sulphate, 5 parts alkyl sulphate and 5 parts water and were made according to the process disclosed in EP-A-0 714 976.

Brightener is Tinopal CDX® supplied by Ciba-Geigy.

EXAMPLE 1

The additives shown under Example 1 in the previous table were mixed together and found to have an average particle size of 440 micrometers.

6.5% of nonionic surfactant (alcohol ethoxylate with an average of 5 EO groups per mole, AES) at 35° C. was sprayed onto the additive mixture in a concrete mixer using a two-fluid spray nozzle. 5% of zeolite A was added into the concrete mixer over a period of 1 minute. The mixer then continued to operate without further addition of zeolite for a further one and a half minutes. Finally a further 8% of zeolite was added over a period of 1 minute.

The product in the concrete mixer had an average particle size of 1020 micrometers.

An anionic surfactant particle was then added to the concrete mixer at a level of 22%. The anionic surfactant particle contained 28 parts linear alkyl benzene sulphonate, 12 parts tallow alkyl sulphate, 30 parts zeolite, 20 parts carbonate and 10 parts water, and had an average particle size of 850 micrometers.

The finished product had an average particle size of 960 micrometers.

EXAMPLE 2

The additives shown under Example 2 in the previous table were mixed together and found to have an average particle size of 390 micrometers.

6.5% of nonionic surfactant (AE5) at 35° C. was sprayed onto the additive mixture in a concrete mixer using a two-fluid spray nozzle. 4% of zeolite A was added into the concrete mixer over a period of 1 minute. The mixer then continued to operate without further addition of zeolite for a further one minute. Finally a further 9% of zeolite was added over a period of 2 minutes.

The product in the concrete mixer had an average particle size of 1080 micrometers.

An anionic surfactant particle was then added to the concrete mixer at a level of 28.6%. The anionic surfactant particle contained 28 parts linear alkyl benzene sulphonate, 12 parts tallow alkyl sulphate, 30 parts zeolite, 20 parts carbonate and 10 parts water, and had an average particle size of 850 micrometers.

The finished product had an average particle size of 1030 micrometers.

EXAMPLE 3

The additives shown under Example 3 in the previous table were mixed together and found to have an average particle size of 390 micrometers.

6.5% of nonionic surfactant (AE5) at 35° C. was sprayed onto the additive mixture in a concrete mixer using a two-fluid spray nozzle. 7% of zeolite A was added into the concrete mixer in a single step.

The product in the concrete mixer had an average particle size of 555 micrometers.

An anionic surfactant particle was then added to the concrete mixer at a level of 28.6%. The anionic surfactant particle contained 28 parts linear alkyl benzene sulphonate, 12 parts tallow alkyl sulphate, 30 parts zeolite, 20 parts carbonate and 10 parts water, and had an average particle size of 410 micrometers.

The finished product had an average particle size of 520 micrometers.

EXAMPLE 4

The additives shown under Example 4 in the previous table were mixed together.

6% of nonionic surfactant (AE5) at 35° C. was sprayed onto the additive mixture in a concrete mixer using a two-fluid spray nozzle. 13% of zeolite A were added into the concrete mixer in discrete portions, 1% at a time.

The product in the concrete mixer had an average particle size of 1000 micrometers.

A spray dried powder was then added to the concrete mixer at a level of 28%. The spray dried particle contained 20 parts linear alkyl benzene sulphonate, 5 parts polyacrylate polymer, 5 parts of chelant, 30 parts zeolite, 30 parts sulphate and 10 parts water, and had an average particle size of 1000 micrometers.

The finished product had an average particle size of 1000 micrometers.

EXAMPLE 5

The additives shown under Example 5 in the previous table were mixed together.

7% of nonionic surfactant (AE5) at 35° C. was sprayed onto the additive mixture in a concrete mixer using a two-fluid spray nozzle. 13% of zeolite A were added into the concrete mixer in discrete portions, 1% at a time.

The product in the concrete mixer had an average particle size of 1050 micrometers.

A spray-dried granule was then added to the concrete mixer at a level of 30%. The spray dried particle contained 20 parts linear alkyl benzene sulphonate, 5 parts polyacrylate polymer, 5 parts of chelant, 30 parts zeolite, 30 parts sulphate and 10 parts water, and had an average particle size of 1000 micrometers.

The finished product had an average particle size of 1020 micrometers.

What is claimed is:

1. A process for making a detergent composition comprising anionic surfactant, nonionic surfactant and non-surfactant additives, the process comprising the steps of:

(i) mixing together at least two non-surfactant additives to form a premix;

(ii) spraying all of the nonionic surfactant on to the premix; subsequently applying a finely divided particulate material to the premix to form a first intermediate particle; and (iii) subsequently mixing the first intermediate particle with a second intermediate spray-dried or agglomerated particle, wherein the second intermediate spray-dried or agglomerated particle comprises from 20 to 40% by weight of anionic surfactant, and is free of nonionic surfactant.

2. A process according to claim 1 wherein the first intermediate particle is formed by:

(a) mixing together at least two non-surfactant additives to form a premix;

(b) spraying nonionic surfactant on to the premix wherein the ratio of nonionic surfactant to premix is at least 1:25;

(c) applying a first amount of finely divided particulate material, wherein the ratio of the first amount of finely divided particulate material to nonionic surfactant applied in step (b) is less than 1:1;

(d) increasing the mean particle size of the premix by mixing; and (e) applying a second amount of finely divided particulate material, wherein the second amount of finely divided particulate material to nonionic surfactant applied in step (b) is greater than 1:1.

3. A process according to claim 2 wherein the first intermediate particle has a mean particle size of from 800 to 1200 micrometers, and the particle size distribution has a standard deviation of less than 100 micrometers.

4. A process according to claim 3 wherein the first intermediate particle has a mean particle size of from 900 to 1100 micrometers, and the particle size distribution has a standard deviation of less than 50 micrometers.

5. A process according to claim 1 wherein the finely divided particulate material is aluminosilicate.

6. A process according to claim 1 wherein at least one of the non-surfactant additives is a bleach selected from the group consisting of perborate, percarbonate, and mixtures thereof.

* * * * *